United States Patent [19]

Zelina, Jr. et al.

[11] 4,233,655

[45] Nov. 11, 1980

[54] SPOTLIGHT

[75] Inventors: Francis J. Zelina, Jr., Erie; John H. Zelina, Jr., Fairview, both of Pa.

[73] Assignee: Lighting Systems, Inc., Erie, Pa.

[21] Appl. No.: 947,779

[22] Filed: Oct. 16, 1978

[51] Int. Cl.[3] ..... F21V 17/00

[52] U.S. Cl. ..... 362/258; 362/311; 362/375; 362/387; 362/390; 362/399

[58] Field of Search ..... 362/399, 311, 112, 258, 362/390, 387, 375

[56] References Cited

U.S. PATENT DOCUMENTS 2,751,581 6/1956 Waltman ..... 362/112 X

*Primary Examiner*—Stephen J. Lechert, Jr.

*Attorney, Agent, or Firm*—Charles L. Lovercheck

[57] ABSTRACT

A spotlight having a generally cylindrical housing with an integral radially extending pistol grip handle at one end, a cord retractor in the rear and a seal beam light closing the open end of the cylindrical housing. The lamp is held in a shock absorbing position by projections on the housing and an integral trigger connected to the housing through a living hinge actuates the switch to turn the light on and off. A trigger lock holds the light "on" and the trigger guard prevents the trigger from being turned on inadvertently. An improved cord holder is provided which utilizes a pinch connection.

20 Claims, 14 Drawing Figures

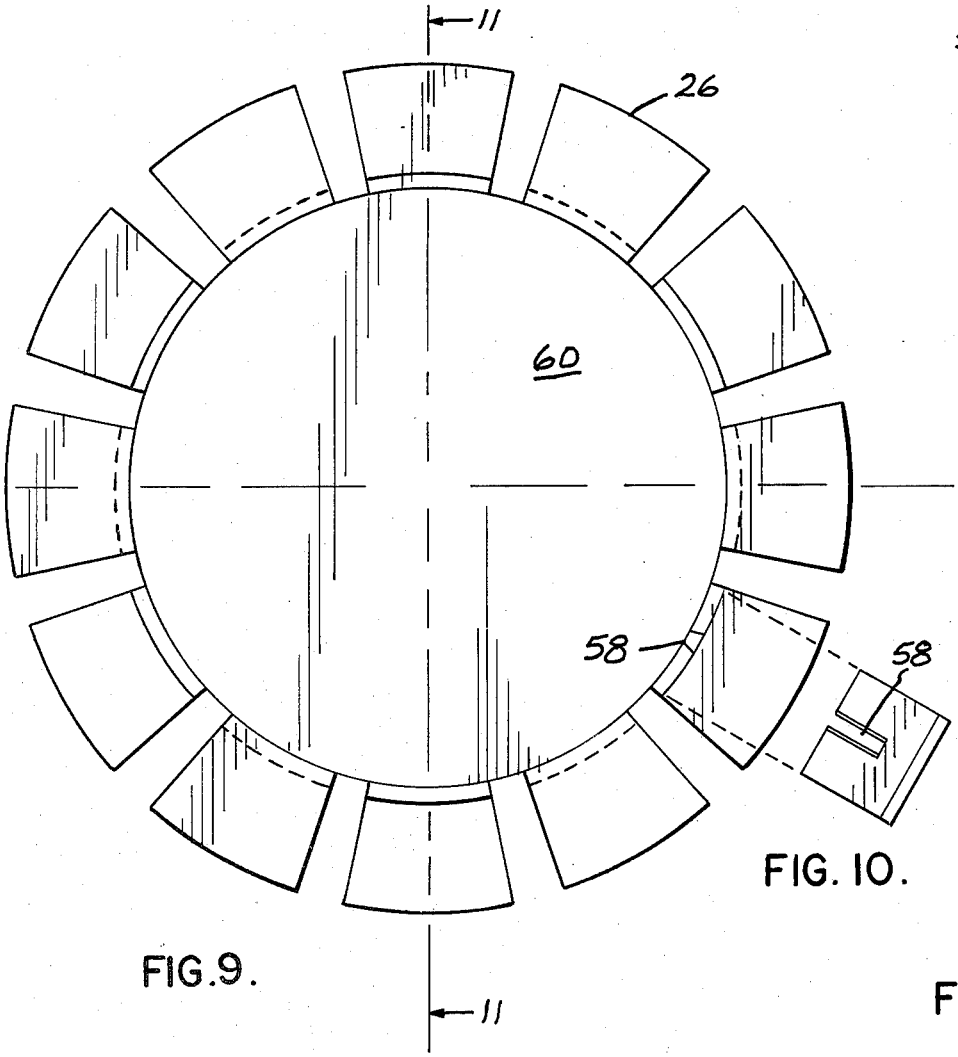
FIG. 9.
FIG. 10.
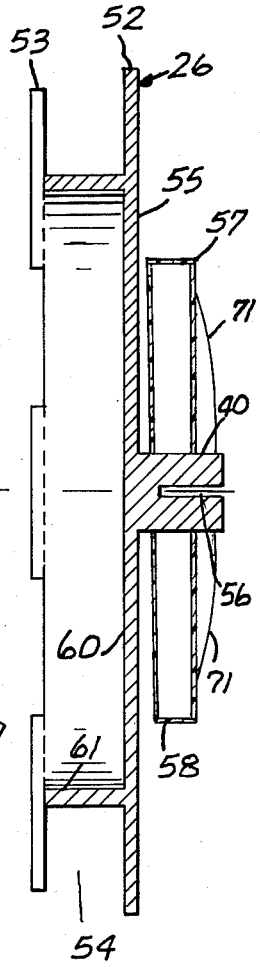
FIG. 11.

SPOTLIGHT

GENERAL STATEMENT OF THE INVENTION

The spotlight according to the invention is made up of a cylindrical housing having shock absorbing fingers extending inwardly and contacting the perimeter of the sealed beam lamp in four places. It has a pistol grip handle with trigger guard and a pistol type trigger for on and off switch actuation. The light can be operated in dual mode; first, the initial travel of the trigger depresses the electrical switch to "close" the normal open contact, release of the finger pressure will "open" the switch. Thus, the trigger action simulates a normally open momentarily closed contact switch.

In the second mode, extended travel of the trigger after the switch has closed, will engage a locking mechanism to keep the switch in a "closed" position without the use of an external finger pressure. The lock is a cantilever arm with a notch in it which engages the end of the trigger, keeping the trigger from returning to its normal position. Disengagement of the lock is obtained by depressing the cantilever arm, thus allowing the trigger to return to its normal position, which "opens" the switch.

The trigger and lock are integral parts of the spotlight housing, giving dual mode switching. As part of the injection molding process, the plastic area where the trigger and the lock meet the housing acts as a "living hinge".

The electrical supply cord is retractable into the lamp housing by means of an integral coil spring and peripheral eye guards on the housing at the sides of the lamp prevent glare of the bulb from irritating persons nearby. The guards are placed at the sides of the lamp rather than above and below. The light assembly is lighter than water so it will float in water and it will operate while submerged.

The retractable cord has a spring operated cam which keeps the cord extended during extraction. Thumb pressure to overcome the cam spring releases the cord which, in turn, is automatically retracted by an internal coil spring. Wires are internally routed through the case walls and are held in place by a pinch connection which locks the wire, binding it and this saves additional tooling; this is known as a regenerative friction connection. The trigger guard reduces the chance of the light being turned on unintentionally. The cord retractor arrangement does not require brushes since the cord itself twists up and takes the turning movement of the cord.

OBJECTS OF THE INVENTION

It is an object of the invention to provide an improved spotlight.

Another object of the invention is to provide a spotlight that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 9 is a view of the cord retractor.

FIG. 10 is a view of the cord pinch area.

FIG. 11 is a cross-sectional view taken on Line 11—11 of FIG. 9.

DETAILED DESCRIPTION OF THE DRAWINGS

Figure 1:
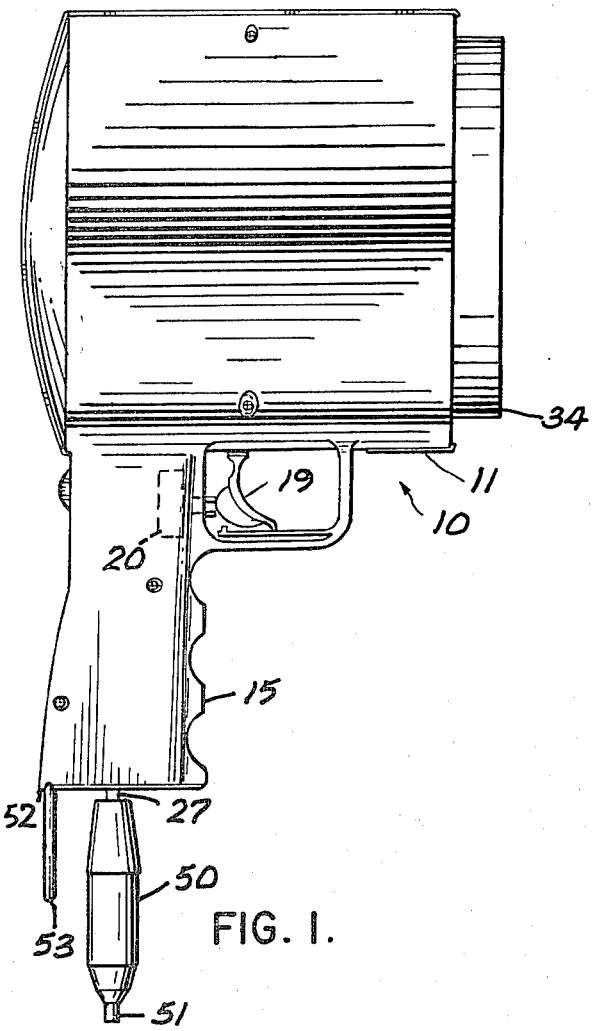
FIG. 1 is a side view of the spotlight according to the invention.
Figure 2:
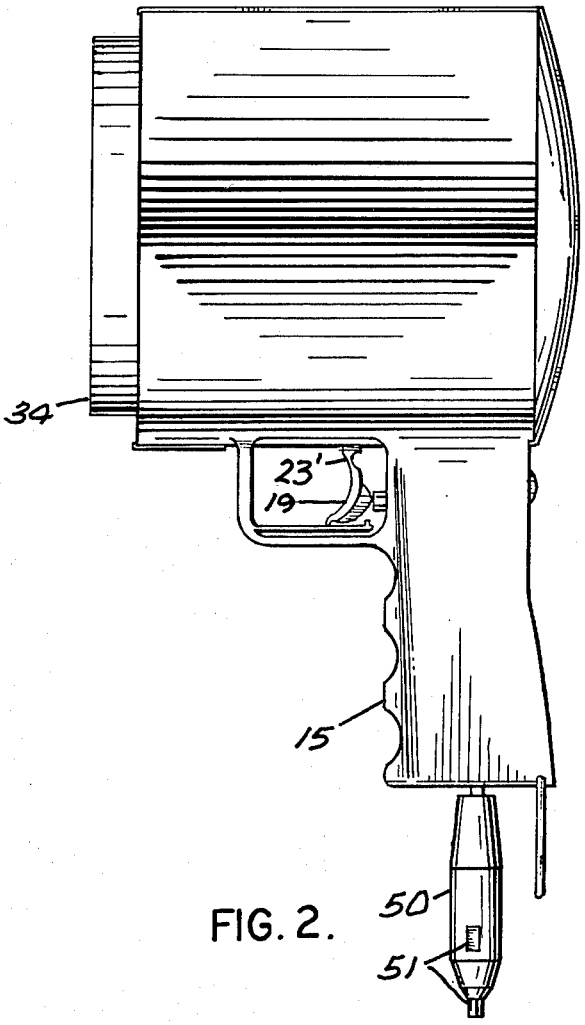
FIG. 2 is a side view of the spotlight.
Figure 3:
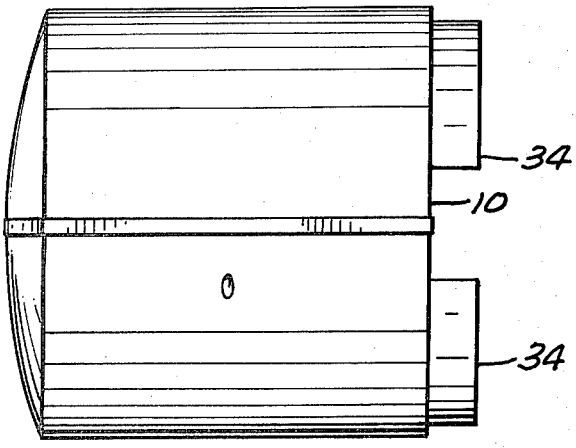
FIG. 3 is a top view of the spotlight.
Figure 4:
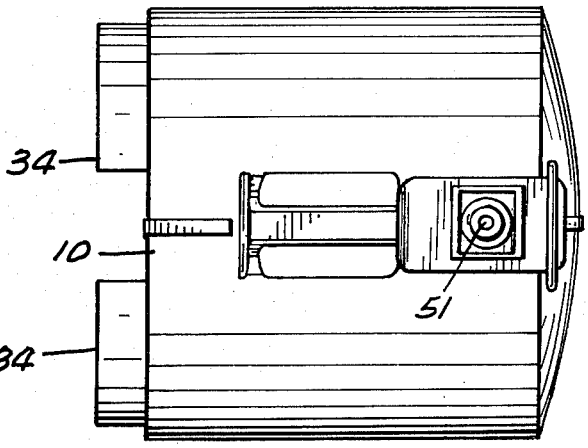
FIG. 4 is a bottom view of the spotlight.
Figure 5:
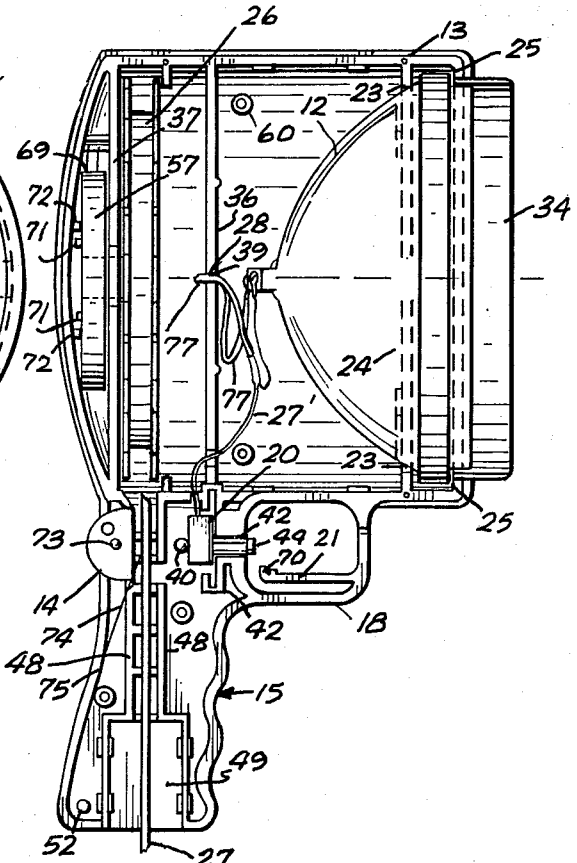
FIG. 5 is a view of the right side of the spotlight taken on Line 5—5 of FIG. 6.
Figure 6:
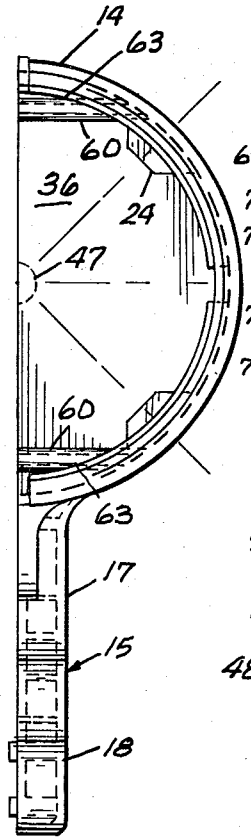
FIG. 6 is a front view of the right side of the spotlight.
Figure 7:
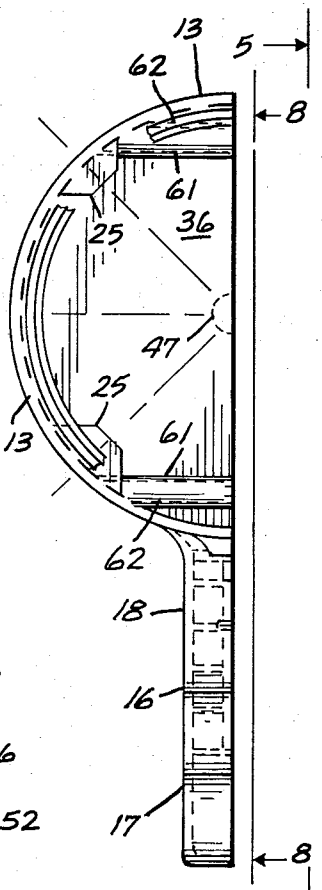
FIG. 7 is a front view of the left side of the spotlight.
Figure 8:
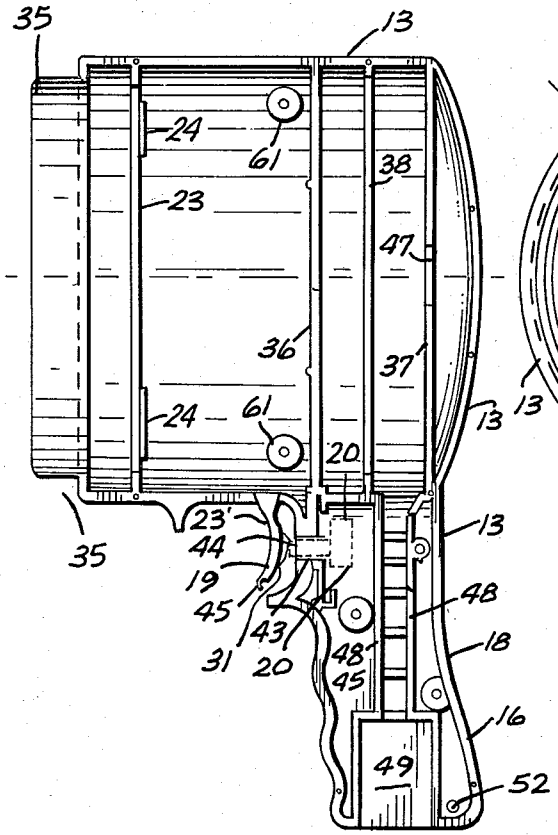
FIG. 8 is a cross-section of the left side of the spotlight.
Figures 12, 13, 14:
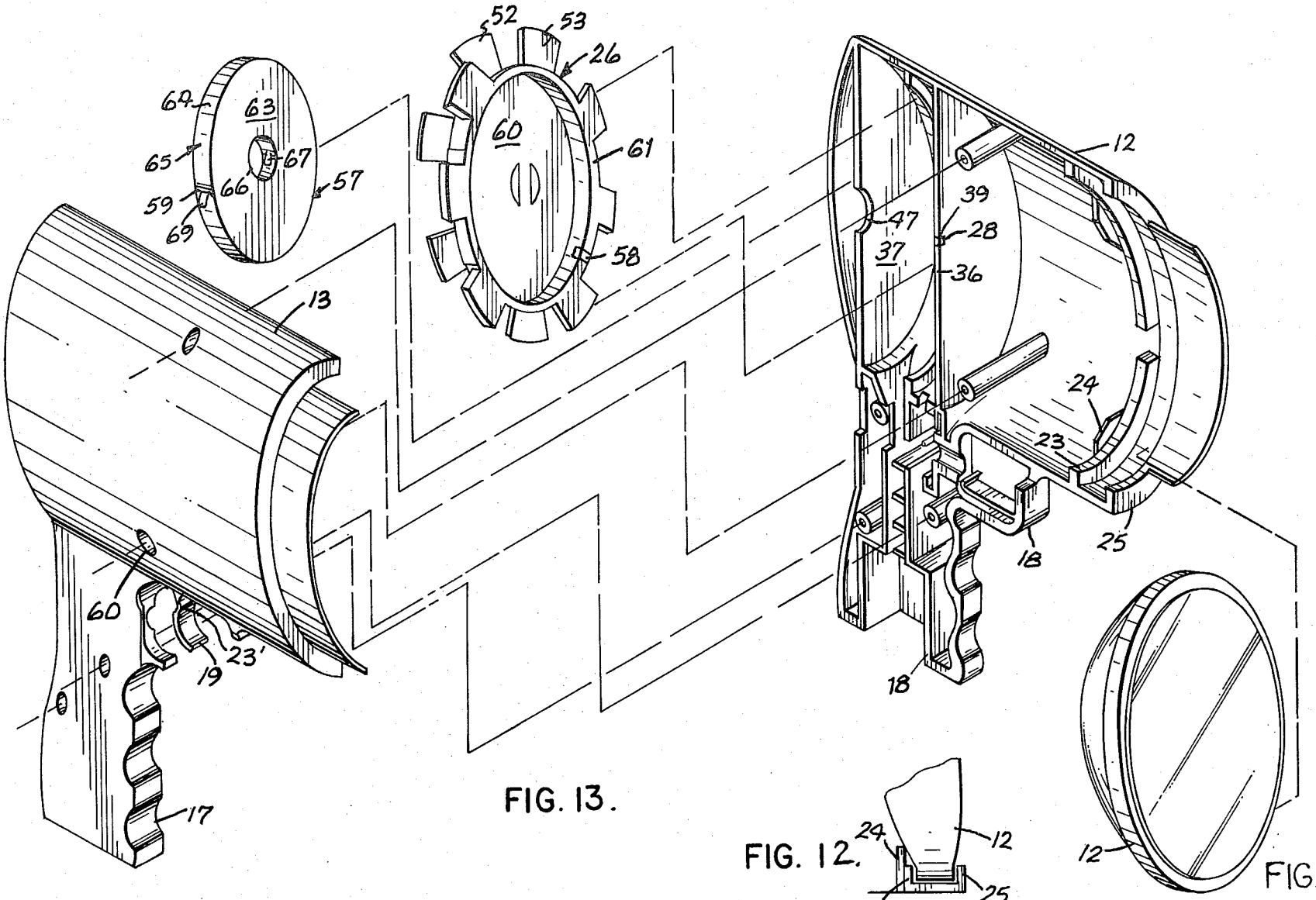
FIG. 12 is an enlarged partial view of FIG. 13.
FIG. 13 is an exploded view of the plastic parts of the light.
FIG. 14 is an isometric view of the seal beam lamp for use with the light according to the invention.

Now, with more particular reference to the drawings. The spotlight generally indicated at 10 has a generally cylindrical housing 11 and lamp 12 received in the front part of the housing. The housing is made up of two halves 13 and 14 with integral two-piece handle and made up of halves 15 and 16 attached to the housing. A trigger means 19 is integrally connected to the housing and surrounded by the trigger guard 18 on housing. The lamp 12 has a generally cylindrical outer periphery that is received in the channel between the radially extending spaced leaves 23, 24 and 25. A switch 20 is supported in the body and it has an actuating member that is engaged by the trigger to turn the light on and off by means of the trigger. The trigger 19 is attached to the body by means of a living hinge 23' which is an integral part of the trigger living hinge. The living hinge is formed by making the trigger thinner at a section adjacent its new connection to the housing providing a thin section 23' thereon. Each half 13 and 14 of the housing has inwardly directed partitions 36 and 37 thereon that extend inwardly to the inner edge of the partitions and one of the partitions 36 has a notch 39 which received the cord. The cord has a resilient insulation which is pressed into the notch 39 which prevents it from rotating relative to the lamp 12 so that the terminal connections to the lamp will not be damaged.

The partition 37 has a semi-circular notch 47 which receives the axle 40 of the cord reel 26. The housing has an inwardly directed flange 38 which extends around the inner periphery of the housing.

The spaced ribs 48 provide a channel receiving the electrical cord and directing it down to the space 49 which receives the plug 50 on the end of the electrical cord. The plug 50 has a terminal end 51 adapted to be received in an ordianry low voltage receptacle such as the cigarette lighter receptacle of the usual automobile. The lower end of each handle halves 15 and 16 has a hole 52 therein which receives an end of ring 53.

The switch 20 is generally rectangular and has a cylindrical portion that rests in half cylindrical recess 43 in each of the halves 13 and 14 and the switch has an actuator 44 which is engaged by the cam 31 on the trigger.

Each half 13 and 14 of the housing has the forward extending eye guards 34 and 35 respectively which prevent the glare of the lamp from interfering with persons nearby. The trigger 19 has an extension 45 on the distal end which engages the notch 70 of the distal end of the trigger lock 21 when it is desired to hold the trigger in depressed position.

The cord reel 26 has the first circumferentially spaced guide members 52 and the rearwardly circumferentiated spaced guide members 53 providing a space 54 for the cord to be reeled into. The rearward disc 55 has an axle 40 integrally molded to it. The axle is received in the notches 47 in partitions 37 when the device is assembled. A central notch 56 receives the end of the spring motor 57'. The notch 58 is provided in the retractor to receive the cord to cause the cord to rotate with the reel. The cord extends from the notch 39 forward to the lamp and is attached to it at its terminals so that the part of the cord between the notch 39 and the lamp will not twist as the reel rotates.

The end 69 of the spring opposite that received in the notch 56 engages the stop 59.

The portable light 10 has a cord 27 and a switch 20 connecting the lamp to a source of energy. The trigger 19 is integrally attached to the lamp housing and has a notch 23 which provides a living hinge for the trigger to flex. The trigger has a switch actuating cam 31 that engages the actuating member 44 which extends through an opening 43 in the housing. The switch is held in position by the stop member 40. A part of the body of the switch 20 is received in each half of the housing and when the housing halves are put together the switch is held rigidly in place.

Trigger guard 18 is integrally attached to the half 14 of the housing. The trigger lock member 21 is integrally attached to the trigger guard 18 and extends rearwardly generally parallel to the trigger guard. The trigger lock 21 can be held down so that the end 45 of the trigger is received in the notch 70 which holds the trigger in place holding the switch in depressed position.

The cord reel 26 which supports the cord 27 is supported between the flange 38 and the partition 37 on the housing. The cord reel 26 has an axle 40 attached to its disc-shaped side 60 which extends outward and through the half openings 47 in the partitions 37. The end of the axle has a slot 56 therein which receives the end 67 of the spring 67 which extends inward. Thus, the end of the spring 67 is held to rotate with the axle 40.

The reel has the secondary disc-like side 60 and the outer peripheral rim 61 integrally attached thereto and extending generally perpendicular to it. The rim has the outwardly extending blades 52 and 53 which support the cord on the reel and a notch 58 in the reel receives the cord and rotates the cord, winding it on the reel.

The outer end 69 of the spring engages the stop 59 on the housing of the spring motor preventing the spring 57 from rotating relative to the spring motor housing 65.

The spring motor 57 has two ribs 71 in its end 64 which fit down between the rib 72 on the housing further preventing the spring motor 57 from rotating relative to the housing. Thus, the spring motor is held against rotation and the end 69 of the spring is, likewise, held. The end 67 of the spring rotates with axle 40 and therefore with the reel 26. The anti-retraction knob 14' is pivoted on axle 73 which is received in recesses in the two halves. The spring 74 rests against the flange 75 and urges the knob 14' to rotate in counterclockwise direction into engagement with the cord 27. Thus, when the operator pulls the cord to its outwardly extended position, he will unwind it from the reel 26 and thereby twist the intermediate portion 77 of the wire between the notch 28 and the reel 26. When the wire is pulled to its outer position, the knob 14' will rotate into engagement with the cord holding it against retraction and against the force exerted on it by the reel.

When the operator moves the knob 14' clockwise, this will pull the lower corner of the knob 14' away from the wire and the reel 26 can then rewind the cord on the reel urged by the spring motor 56.

The foregoing specification sets forth the invention in its preferred, practical forms but the sructure shown is capable of modification within a range of equivalents without departing from the invention which is to be understood is broadly novel as is commensurate with the appended claims.

The embodiments of the invention in which an exclusive property or privilege is claimed are defined as follows:

1. A spotlight (10) comprising,
a housing (11),
said housing being made of two halves (13,14),
said two halves enclosing a hollow space having an open front end,
a lamp (12) in said hollow space in said housing (11),
a handle (15) having two halves each said half being integrally fixed to said halves of said housing (11),
each of said halves (13,14) having radially inwardly directed circumferentially spaced first leaves (25) adjacent said open end and inwardly directed circumferentially spaced second leaves (24) adjacent said open end and spaced from said first leaves integrally fixed thereto,
said lamp having a generally round shaped rim adjacent said open front end,
said rim being received between the said first leaves and said second leaves (24),
said second leaves providing a shock absorbing means for supporting said lamp whereby damage to said lamp from impact of said housing is minimized.

2. A spotlight (10) comprising,
a housing (11),
said housing being made of two halves (13,14),
said two halves enclosing a hollow space,
a lamp (12) in said hollow space in said housing,
said first half having a trigger (19) integrally attached thereto,
a switch (20) supported on said first half adjacent said trigger,
said switch (20) having actuating means thereon adapted to be engaged by said trigger and a living hinge connecting said trigger to one said half.

3. The lamp recited in claim 1 wherein said housing has a second hollow space adjacent to said first hollow space,
a reel in said second hollow space,
a cord extending through said housing to said reel means supporting said cord on said housing,
said cord having a substantial length thereof extending into said second hollow space engaging said reel whereby said cord can be twisted by said reel when said reel winds the cord thereon.

4. The lamp recited in claim 3 wherein said cord is connected to said first half of said housing between said first hollow space and said second hollow space and a means having a slot therein receiving said cord, said cord having a resilient insulation thereon, said insulation being substantially larger than the width of said slot whereby said slot distorts said insulation and holds said cord to said partition.

5. The lamp recited in claim 4 wherein a spring operated cam is supported on said housing and engages said cord, said cam having a thumb engaging means thereon for overcoming the cam spring to release said cord whereby said cord is automatically retracted by said reel.

6. The lamp recited in claim 1 wherein said housing halves each have eye guards extending radially inwardly from the outer periphery thereof to intercept light, thereby preventing glare from said lamp from irritating the eyes of bystanders.

7. The lamp recited in claim 6 wherein said lamp is made of a plastic material lighter than water whereby said lamp will float.

8. The lamp recited in clain 2 wherein each said half of said housing has two axially spaced inwardly extending partitions therein defining a space and a cord reel is disposed in said space.

9. The lamp recited in claim 8 wherein one said partition has a notch therein and said cord is squeezed into said notch whereby the insulation on said cord is pinched preventing a part of said cord from rotating with said reel.

10. The lamp recited in claim 9 wherein a spring motor is supported in said housing adjacent to said cord reel and connected to said cord reel urging said cord reel to reel said cord thereon, said cord extends outward through said handle, a cam is supported on said handle adjacent said cord engaging said cord and holding said cord against the force of said reel, said cam being engageable by the hand of an operator whereby said cord can be released and reeled onto said reel.

11. The lamp recited in claim 2 wherein said housing halves each have eye guards extending radially inwardly from the outer periphery thereof to intercept light, thereby preventing glare from said lamp from irritating the eyes of bystanders.

12. The lamp recited in claim 2 wherein said lamp is made of a plastic material lighter than water whereby said lamp will float.

13. The light recited in claim 2 wherein a trigger lock is provided, said trigger lock being integrally attached to said trigger guard and extending rearwardly and underlining said trigger, said trigger guard having a notch adjacent to said rearward end, said notch being adapted to receive the end of said trigger for holding said trigger in depressed position thereby holding said switch in actuating position.

14. The light recited in claim 9 wherein said housing has a rear-end spaced from said partition, said rear-end defining a space receiving a spring motor, said one partition on each said housing half having a notched end and an axle on said part extending through said notch and engaging the spring of said spring motor.

15. In combination, a portable light having a lamp 12, a cord for said lamp 12, switch means on said lamp for connecting a source of energy through said cord to said lamp, a trigger 19 integrally attached to said lamp 12, said trigger 19 having a switch engaging means therein adapted to engage said switch for actuating said switch.

16. An electrical device comprising, a housing, a part to be energized supported by said housing, electrical means for supplying energy to said part, switch means supported by said housing and adapted to be connected to an electrical means, a trigger, an integral means integrally connecting said trigger to said housing, said integral means comprising a reduced size section of said trigger acting as a living hinge whereby said trigger is swingably connected to said housing, and means on said trigger for engaging said switch whereby said switch connects said electrical means to said part.

17. The device recited in claim 16 wherein locking means is provided for holding said trigger in a predetermined position, said locking means comprising a cantalever arm integrally connected to said housing, said cantalever arm having locking means on the distal end thereof for engaging said trigger for holding said trigger in a predetermined position, said cantalever means being adapted to swing away from said trigger, allowing said trigger to move freely.

18. An electrical device comprising, a housing, a part to be energized supported on said housing, electrical means for supplying energy to said part, switch means supported on said housing and connected to said electrical means, a trigger swingably connected to said housing, resilient means urging said trigger away from said switch, said trigger having means thereon adapted to engage said switch for energizing said part, locking means provided on said housing for holding said trigger in predetermined position, said locking means comprising a cantalever arm integrally connected to said housing, said cantalever arm having locking means on the distal end thereof for engaging said trigger for holding said trigger in predetermined position, said cantalever arm being adapted to be swung away from said trigger, allowing said trigger to freely move.

19. A light device comprising, a device housing, a part supported on said housing to be energized, a cord, switch means supported on said housing and adapted to connect said cord to said part, a cord retractor supported on said housing, said cord retractor comprising a cord reel rotatably supported on said housing, a spring motor connected to said cord reel and adapted to reel said cord onto said cord reel when said cord is released and means for locking said cord in extended position.

20. The device recited in claim 19 wherein said housing has a handle and said cord extends through said handle and plug means on the distal end of said cord adapted to be received in said handle when said cord is in retracted position.

* * * * *